United States Patent [19]

Fisher

[11] Patent Number: 4,867,721

[45] Date of Patent: Sep. 19, 1989

[54] WATER SKI

[76] Inventor: Larry C. Fisher, 539 Grandberry St., McKenzie, Tenn. 38201

[21] Appl. No.: 204,351

[22] Filed: Jun. 9, 1988

[51] Int. Cl.[4] ..... A63C 15/00

[52] U.S. Cl. ..... 441/68; 114/125

[58] Field of Search ..... 441/68, 79; 114/125, 114/360

[56] References Cited

U.S. PATENT DOCUMENTS

| | | | |
|---|---|---|---|
| 655,993 | 8/1900 | Riess et al. | 114/360 X |
| 3,372,408 | 3/1968 | Luger et al. | 114/357 |
| 3,380,090 | 4/1968 | Kenmuir | 114/357 |
| 3,736,608 | 6/1973 | Whitehead | 114/125 X |
| 4,528,927 | 7/1985 | Iizuka et al. | 114/125 |
| 4,538,538 | 9/1985 | Carbonel | 114/125 |

*Primary Examiner*—Sherman D. Basinger

*Attorney, Agent, or Firm*—Harrington A. Lackey

[57] ABSTRACT

A water ski including a buoyant fore section and an elongated hollow, fluid aft chamber in fluid communication with rear ports in the rear end of the ski and air ports in the top surface of the fore section of the ski whereby the aft section of the ski is flooded when the ski is relatively stationary in the water to cause said ski to assume an upright position in the water and which chamber is rapidly purged of water when said ski is in forward motion to assume a balanced, substantially horizontal skiing position on the water.

12 Claims, 2 Drawing Sheets

WATER SKI

BACKGROUND OF THE INVENTION

This invention relates to water skis, and more particularly to a water ski having a floodable fluid chamber to permit change in the weight distribution when the water ski is in motion or stationary.

Conventional water skis are made of uniform, solid buoyant material, such as wood, fiberglass or other plastic compositions, with a weight distribution such that when the ski is stationary in the water, it floats flat on top of the water. When the ski is in skiing position moving forward through the water, it has the same weight distribution as it does when it is stationary, except that it asumes a planing attitude, with the forward end of the ski slightly raised.

However, when a skier attempts to place the skis on his feet in the water, the aft sections of the skis must be manually forced downward into the water so that the ski assume a substantially upright positions to permit the skier to insert his feet in the foot supports or foot harness on the respective skis. Sometimes it is difficult enough to insert each foot into a separate ski, much less maintain the buoyant aft section of the ski depressed under water while the foot is being inserted. After the skis have been assembled upon the feet of the skier, then the skier must still force the buoyant aft sections of the skis downward and simultaneously maintain the skis substantially parallel and upright until the skier is drawn forward by the ski rope pulled by the towing motor boat.

Furthermore, after a skier becomes separated from his skis, such as by falling or loss of control, sometimes, it is difficult for the skier to relocate the separated skis which are floating flat on top of the water, particularly where waves are present which conceal the skis from view of the skier whose eyes are substantially at water level.

Applicant is aware of only two instances of prior attempts to solve the above problems. One is the water ski disclosed in the U.S. Pat. No. 3,031,697 to Klein, in which the front or fore portion of the ski is made buoyant, while the aft or rear section of the ski is provided with a fixed lead weight in order to provide a permanent weight variation between the fore and aft sections of the ski. Although the Klein U.S. Pat. No. 3,031,697 provides a solution for maintaining the water ski in an upright position when it is in a relatively stationary position, nevertheless, the skier must contend with the same weight variation between the fore and aft sections when the skis are in their skiing position. In other words, the Klein water ski is provided with a permanent unbalanced weight distribution in the fore-aft direction, whether the ski is in motion or stationary.

The U.S. Wright U.S. Pat. No. 4,296,511 discloses a water ski having an elongated air chamber extending throughout the middle section of the ski with a large air inlet in the top of the fore section of the ski. The rear end portion of the air chamber has a discharge aperture 28 in the bottom surface of the ski communicating with the water supporting the ski. A transverse skag 11 is mounted on the ski beneath the discharge aperture 28 to create a Venturi effect beneath the bottom surface of the ski. Moreover, the passage of fluid, either water or air, through the discharge aperture 28 is controlled by a vane 32 journaled about a transverse axis and normally biased to an open position when the ski is in a substantially stationary position. In the stationary position, with the pivotal vane open, the air chamber 25 is flooded to cause the ski to attain an upright position. When the ski is in forward motion, the rearward movement of the water closes the pivotal vane 32 to close the air chamber 25. However, the vane is provided with a plurality of small nozzles 33 which will permit limited passage of first water, and then air, from the air chamber downward beneath the ski, as the ski moves forward through the water.

Since the air chamber 25 in the Wright U.S. Pat. No. 4,296,511 is disclosed in substantially the mid-section of the ski and there is a solid aft portion of the ski located behind the air chamber, then the solid aft portion must have a density greater than that of water in order to facilitate the downward movement of the aft section of the ski when the air chamber 25 is flooded. If this is true, then there will be a permanent imbalance between the fore and the aft densities of the ski, even when the water from the air chamber has been discharged during the forward skiing motion of the ski. Furthermore, it is noted in the Wright patent that the rearward movement of the water within the chamber 25 when the ski begins to plane, has to change direction from rearward to downward, as well as having to pass through the constricted nozzles 33.

Furthermore, it is noted in the Wright patent that the transverse strength of the ski is diminished across the rear portion of the air chamber 25 where the pivotal vane 32 is located, an area where the stress is substantially great.

Other skis having fluid passages are disclosed in the following U.S. Pat. Nos.

2,382,150, Hartman, Aug. 14, 1945
3,284,823, Steffel, Nov. 15, 1966
3,318,609, Ross, May 9, 1967
3,874,315, Wright, Apr. 1, 1975

SUMMARY OF THE INVENTION

It is therefore an object of this invention to provide a water ski in which the weight distribution throughout the length of the ski is balanced during its operative skiing position and the weight distribution is unbalanced toward the aft section when the ski is in an inoperative stationary position in the water.

A further object of this invention is to provide a water ski having a buoyant fore section and a fluid chamber in the aft section adapted to be flooded with water when the ski is in an inoperative stationary position and quickly purged of water during its operative skiing position.

Another object of this invention is to provide a water ski having a floodable aft chamber for unbalancing the weight toward the aft section to position the ski in an upright position, not only for better visibility of the ski in the water, but also to facilitate mounting the ski by the skier.

The water ski made in accordance with this invention includes an elongated body member having a buoyant fore section and a hollow fluid chamber within the aft section communicating with a plurality of rear ports formed in the rear end of the ski and also communicating with a plurality of air ports formed in the top surface of the fore section of the ski.

A further object of this invention is to provide a water ski having closed fluid chambers in its fore section to provide buoyancy and open fluid chambers in its aft section to permit rapid entry and discharge of water in order to change the weight distribution in the ski for its operative skiing position and its inoperative stationary position.

A further object of this invention is to provide a water ski having a substantially uniform weight distribution when the ski is in its substantially level operative position, and having a means for increasing the weight in the aft section of the ski only when the ski is inoperative, in order to dispose the ski in an upright position.

DESCRIPTION OF THE PREFERRED EMBODIMENTS

Figures 1, 2, 3:
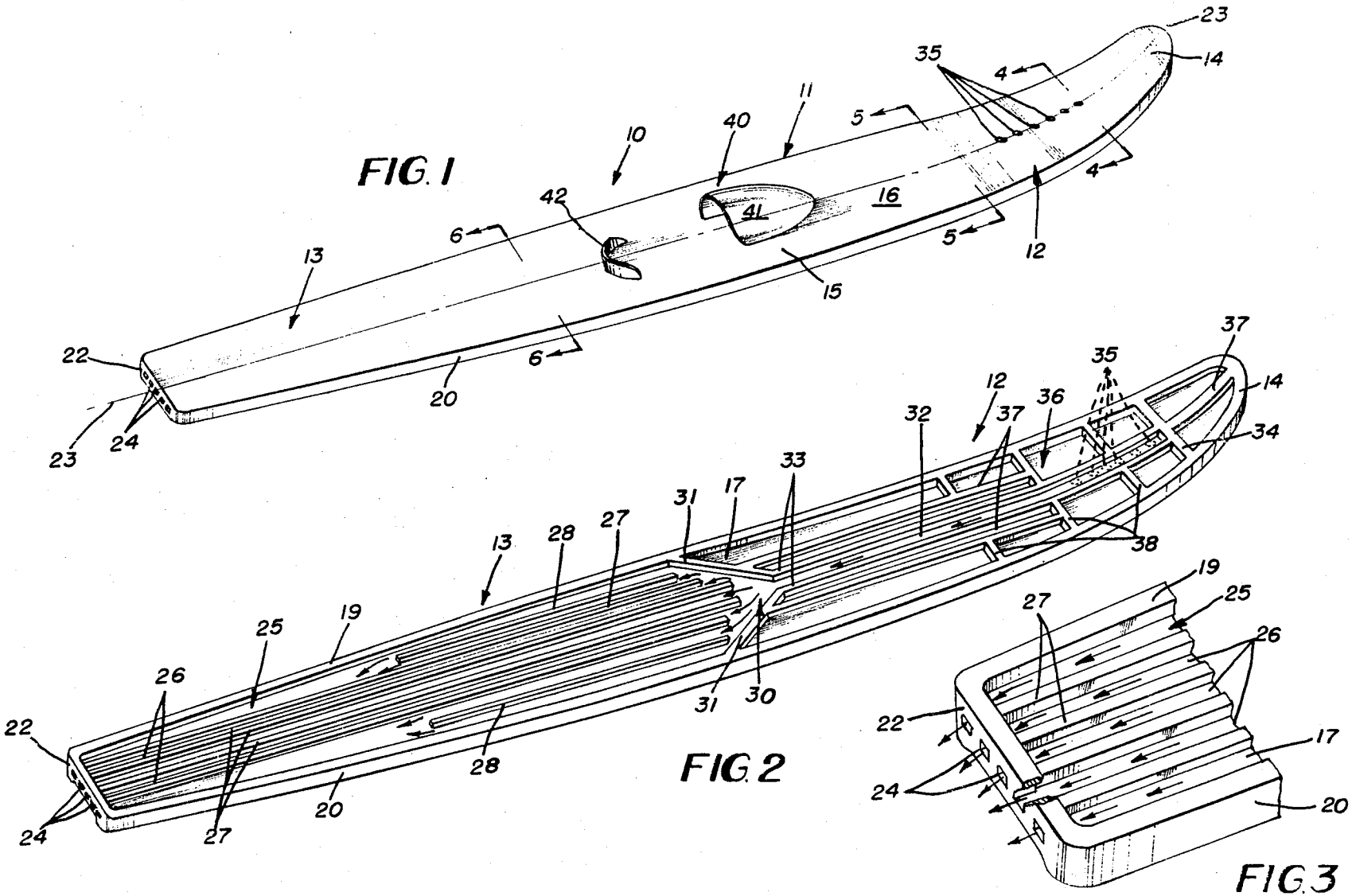
FIG. 1 is a top perspective view of the water ski made in accordance with this invention.
FIG. 2 is an enlarged view of the ski disclosed in FIG. 1, with the top panel removed, but illustrating the location of the air ports, in phantom.
FIG. 3 an enlarged, fragmentary, top perspective view of the rear portion of the ski disclosed in FIG. 2, without the top panel, and with a portion of the rear end wall broken away.
Figure 4:
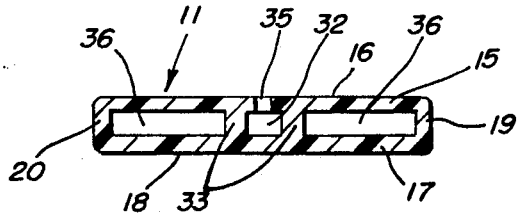
FIG. 4 is an enlarged section taken along the line 4—4 of FIG. 1.
Figure 5:
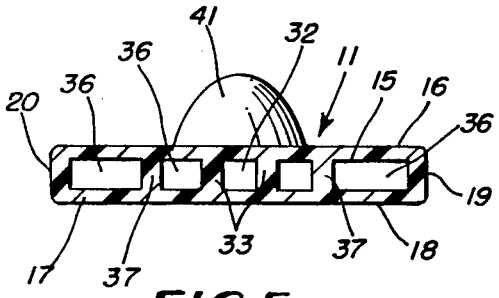
FIG. 5 is an enlarged section taken along the line 5—5 of FIG. 1.
Figure 7:
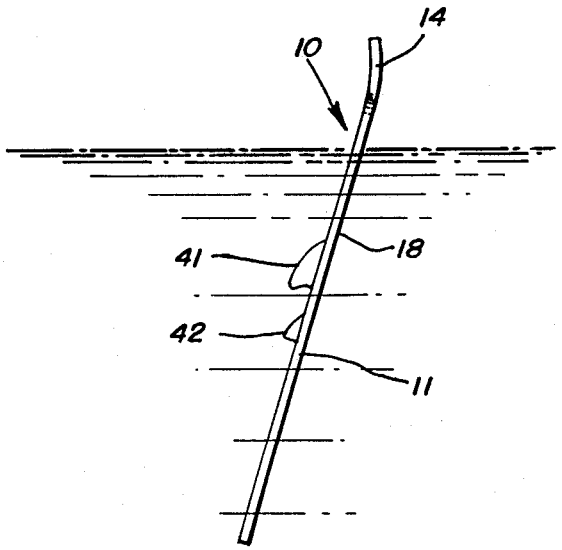
FIG. 7 is a side elevation of the water ski in its upright inoperative position in a body of water, shown at a reduced scale.

Referring now to the drawings in more detail, FIGS. 1 and 7 disclose a water ski 10 made in accordance with this invention, including an elongated body member 11 having a fore section 12 and an aft section 13. The fore section 12 terminates in an upwardly curved front tip portion 14 in a conventional manner for water skis.

The elongated body member 11 is predominantly hollow, and includes an elongated top panel 15 having a top surface 16 and an elongated bottom panel 17 having a bottom planing surface 18. The top wall 15 and bottom wall 17 are separated by elongated side walls 19 and 20 extending the full length of the body member 11 and merging in the tip portion 14. The rear ends of the side walls 19 and 20 terminate in a transverse rear end wall 22. The rear end wall 22 is preferably perpendicular to the longitudinal axis 23 of the body member 11, extending front-to-rear.

Extending through the rear end wall 22 are a plurality of transversely spaced fluid ports 24 having longitudinal front-to-rear flow axes.

Figure 6:
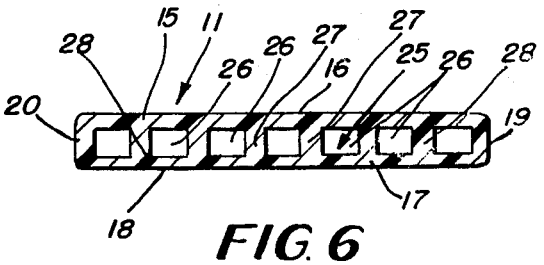
FIG. 6 is an enlarged section taken along the line 6—6 of FIG. 1.

Formed within the hollow aft section 13 of the body member 11, as best disclosed in FIGS. 2, 3, and 6, is a fluid chamber 25 divided into a plurality of substantially parallel fluid channels 26 by a plurality of transversely spaced elongated straight rib members 27. As best disclosed in FIG. 2, in the forward portion of the aft chamber 25 are a pair of extra shorter side rib members 28 which provide additional side fluid channels 26.

The front ends of the rib members 27 and 28 terminate in a forward space 30 functioning as a manifold chamber which is confined by the forward and inward projecting manifold walls 31, which converge and merge into an elongated central connector channel 32 having side walls 33. The connector channel 32 extends forwardly and terminates in a forward cross wall 34. The front portion of the connector channel 32 is in fluid communication with a plurality of longitudinally spaced apertures or air ports 35 extending through the top wall 15 of the body member 11. In FIG. 2, the top wall or panel 16 has been removed in order to show the interior structure of the body member 11 and also the relative location of the air ports 35.

Filling the hollow spaces in the fore section 12 around the connector channel 32 may be any type of buoyant material to render the fore section 12 buoyant, that is having a specific gravity less than that of water. As disclosed in the drawings, such space is divided into small air pockets or compartments 36 by a plurality of longitudinal walls 37 and transverse walls 38. The pockets 36 could be filled with buoyant material other than air, such as plastic foam material.

As best disclosed in FIGS. 1 and 7, fixed to the top surface 16 of the top panel or wall 15 is a foot support 40 including a toe pocket 41 and a heel support 42 of conventional construction.

The rib members 27 and 28 and the channel walls 33 not only function to channel the fluid, whether water or air, in substantially straight paths in order to expedite the movement of the fluid longitudinally of the ski in either direction, depending upon whether the chamber 25 is being flooded or exhausted, but also functions to reinforce the structure of the ski body member 11. Likewise, the longitudinal and transverse walls 37 and 38 used to confine the air chambers or pockets 36 in the fore section 12, also function to reinforce the structure of the ski body member 11. The particular pattern for the number and arrangement of the walls 37 and 38 is not particularly material, so long as these walls provide adequate strength and rigidity for the ski as well as to contain a sufficient amount of buoyant material to render the fore section 12 buoyant.

It will be noted in the drawings, that the transverse cross sectional structure of the body member 11 is a box beam structure, that is a hollow structure confined by continuous top, bottom, and side members, namely the top wall 15, the bottom wall 17 and the two side walls 19 and 20 to give adequate rigidity throughout the entire length of the ski body member 11.

The structure, weight and location of the rib members 27, 28, 33, 37, and 38 are such that when the water ski 10 is in its skiing position or resting flat in a substantially horizontal or planing position upon the water, there is substantially equal weight distribution fore and aft of the ski body member 11. Only when water is introduced into the aft chamber 25 will there be a substantial imbalance in the longitudinal weight distribution.

Although only a single water ski is disclosed in the drawings, nevertheless, it will be understood that the skier will utilize a pair of skis, each of which is either identical to the other, or the mirror image of the other, in construction. On the other hand, it is also possible to incorporate the structure of the above ski in a single slalom ski.

In commencing the use of a pair of water skis 10 made in accordance with this invention, the skier places both skis on the surface of the water in front of the skier, pointing forward. Since the rear end wall 22 is slightly submerged, water immediately enters the fluid ports 24 to rapidly fill the chamber 25, passing through all of the longitudinal channels 26. As the fluid chamber 25 fills with water, the center of gravity of each ski 10 shifts rearward causing the rear end of each ski 10 to submerge and the tip portion 14 to rise until the ski 10 attains its over-balanced or overweighed weighted upright position disclosed in FIG. 7. The flooded skis 10 are then maintained in their stable upright position by the flooded chambers 25 while the skier inserts each foot into the corresponding foot support 40, without having to manhandle the skis 10 and hold the aft end portions of the skis in a submerged position while mounting the skis.

After the skier has mounted the skis 10 and grasps the tow rope which is pulled through the water by a towing boat, not shown, the skis 14 supporting the skier are moved forward through the water toward a planing position. The inertia and gravity of the water within the chamber 25 causes the water 25 to rapidly discharge through the channels rearward through the rear fluid ports 24 to empty the chamber 25. The flow of the water through the rear ports 24 is facilitated by the relative rearwardly moving air through the air ports 35, into the aft chamber 25 through the connector channel 23 to eliminate any vacuum created in the front portion of the aft chamber by the relative rearward movement of the water. Consequently, the air displaces the water in the chamber 25, to substantially equalize the longitudinal weight distribution of the ski 10.

The rearward movement of the water through the rear fluid ports 24 sucks air from the atmosphere through the air ports 35 and the connector channel 32 into the trunk portion and ultimately the entire fluid chamber 25, to eliminate all the water from the body member 11 while the ski 10 is moving forward across the surface of the water.

At any time when the ski 10 ceases to move forward through the water, the submerged rear end wall 22 permits water to be introduced into the chamber 25 through the rear ports 24 to again flood the aft chamber 25 and again restore the ski to its inoperative upright stable position disclosed in FIG. 7.

The rear ports 24 are located in the rear end wall 22 of the ski body member 11 so that each port 24 has a front-to-rear flow axis. The straight parallel arrangements of the fluid channels 26 and the connector channel 32 permit a direct flow of fluid, either air or water, longitudinally of the ski when the ski 10 is changing from an upright inoperative position to a substantially flat or horizontal operative skiing position, or vice versa.

It will be seen in FIG. 7, that the submerged attitude of each ski 10 not only facilitates the attachment of the skis 10 to the feet of the skier without the undue burden of forcing the aft ends of the skis into the water, but also the tip portion 14 of each ski rises above the water a substantially greater distance than it would if it were lying flat on the water to provide greater visibility and location of the ski. The tip portions 14 of each ski 10 may also be painted a bright and clearly visible color to facilitate detection in the water.

What is claimed is:

1. A water ski comprising:

(a) an elongated body member having front end portion, a rear end, top and bottom surfaces, a longitudinal axis extending front-to-rear, a longitudinal fore section, and a longitudinal aft section behinds said fore section, (b) said aft section comprising an elongated, hollow, aft fluid chamber having a rear end portion extending substantially to said rear end, and a front end portion, (c) a rear fluid port extending through said rear end, in fluid communication with said rear end portion of said aft fluid chamber, (d) a plurality of air ports extending through said top surface of said fore section in fluid communication with said front portion of said aft fluid chamber, (e) said fore section being buoyant in water, (f) said body member having a longitudinal weight distribution permitting said body member to assume a longitudinal, substantially level, operative position on the surface of a body of water when said aft fluid chamber is empty of water, and (g) said body member having an upright inoperative position in said body of water when said aft fluid chamber is filled with water, said aft section being completely submerged in said body of water and only said front end portion projecting above said surface of said body of water in said inoperative position.

2. The invention according to claim 1 in which said aft fluid chamber spans substantially the entire width of said aft section.

3. The invention according to claim 2 further comprising a plurality of longitudinal fluid channels extending substantially the entire length of, and within, said aft fluid chamber, a plurality of said rear fluid ports, each said channel being in fluid communication with one of said rear fluid ports.

4. The invention according to claim 3 in which said rear end comprises a rear end wall substantially normal to said longitudinal axis, said rear fluid ports extending longitudinally through said rear end wall.

5. The invention according to claim 4 further comprising a plurality of substantially elongated, parallel rib members within said hollow fluid chamber and extending from said top and bottom surfaces to define said elongated fluid channels.

6. The invention according to claim 5 in which said rear end portions of said rib members terminate in said rear end wall between said rear fluid ports, a manifold chamber within said front portion of said hollow fluid chamber in fluid communication with said air ports and said elongated channels.

7. The invention according to claim 2 further comprising a longitudinally extending connecting fluid channel in fluid communication between said air ports and said front end portion of said fluid chamber.

8. The invention according to claim 7 in which said connecting channel extends through said fore section, and further comprising a plurality of buoyant chambers within said fore section containing buoyant material.

9. The invention according to claim 8 in which said buoyant material is air.

10. The invention according to claim 1 in which said elongated body member comprises a transverse box beam structure substantially normal to said longitudinal axis and continuous throughout the length of said body member.

11. The invention according to claim 1 further comprising a foot support on said top surface.

12. The invention according to claim 1 in which said body member comprises top and bottom panels, said top panel having said top surface and said bottom panel having said bottom surface, said hollow aft fluid chamber extending from said bottom panel to said top panel.

* * * * *